US010994334B2

(12) United States Patent
Lee et al.

(10) Patent No.: US 10,994,334 B2
(45) Date of Patent: May 4, 2021

(54) METHOD FOR PREPARING RICE EAR-SHAPED COPPER PARTICLES, RICE EAR-SHAPED COPPER PARTICLES PREPARED THEREBY, AND CONDUCTIVE PASTE USING SAME

(71) Applicant: Foundation for Research and Business, Seoul National University of Science and Technology, Seoul (KR)

(72) Inventors: Jong-Hyun Lee, Seoul (KR); Jun Ho Hwang, Gyeonggi-do (KR)

(73) Assignee: Foundation for Research and Business, Seoul National University of Science and Technology

( * ) Notice: Subject to any disclaimer, the term of this patent is extended or adjusted under 35 U.S.C. 154(b) by 0 days.

(21) Appl. No.: 16/474,765

(22) PCT Filed: Jan. 17, 2017

(86) PCT No.: PCT/KR2017/000548
§ 371 (c)(1),
(2) Date: Jun. 28, 2019

(87) PCT Pub. No.: WO2018/124365
PCT Pub. Date: Jul. 5, 2018

(65) Prior Publication Data

US 2019/0344353 A1 Nov. 14, 2019

(30) Foreign Application Priority Data

Dec. 29, 2016 (KR) ..... 10-2016-0183021

(51) Int. Cl.
*B22F 9/24* (2006.01)
*B22F 1/00* (2006.01)
(Continued)

(52) U.S. Cl.
CPC ..... *B22F 9/24* (2013.01); *B22F 1/0011* (2013.01); *B22F 1/025* (2013.01); *H01B 1/22* (2013.01);
(Continued)

(58) Field of Classification Search
None
See application file for complete search history.

(56) References Cited

U.S. PATENT DOCUMENTS

| | | | | |
|---|---|---|---|---|
| 8,999,881 | B2 | 4/2015 | Budiman et al. | |
| 9,676,034 | B2 | 6/2017 | Chung et al. | |
| 2014/0283650 | A1* | 9/2014 | Chung | C22C 5/02 75/346 |

FOREIGN PATENT DOCUMENTS

| | | | |
|---|---|---|---|
| CN | 104830247 A | * | 8/2015 |
| JP | 2016176093 A | | 10/2016 |

(Continued)

OTHER PUBLICATIONS

English translation of CN 104830247 (originally published Aug. 12, 2015) from Espacenet.*

*Primary Examiner* — George Wyszomierski
(74) *Attorney, Agent, or Firm* — Mendelsohn Dunleavy, P.C.

(57) ABSTRACT

The present invention relates to ear-of-rice-shaped copper particles. The technical gist thereof is a method of manufacturing ear-of-rice-shaped copper particles, ear-of-rice-shaped copper particles manufactured thereby, and a conductive paste using the same. The method includes a first step of preparing a copper precursor solution, a second step of adjusting the pH of the copper precursor solution, a third step of adding a zinc powder to the pH-adjusted copper precursor solution, a fourth step of synthesizing the ear-of-rice-shaped copper particles by stirring the copper precursor solution, to which the zinc powder is added, for a predeter-
(Continued)

mined time, and a fifth step of separating, washing, and then drying the synthesized ear-of-rice-shaped copper particles.

9 Claims, 11 Drawing Sheets

(51) Int. Cl.
*B22F 1/02* (2006.01)
*H01B 1/22* (2006.01)

(52) U.S. Cl.
CPC ..... *B22F 2301/10* (2013.01); *B22F 2301/255* (2013.01)

(56) References Cited

FOREIGN PATENT DOCUMENTS

| | | | |
|---|---|---|---|
| KR | 1020130009592 | A | 1/2013 |
| KR | 1020130047913 | A | 5/2013 |
| KR | 1020140060417 | A | 5/2014 |
| WO | WO2014060047 | A1 | 4/2014 |

* cited by examiner $$2Al + 3Cu^{2+} \longrightarrow 2Al^{3+} + 3Cu$$

METHOD FOR PREPARING RICE EAR-SHAPED COPPER PARTICLES, RICE EAR-SHAPED COPPER PARTICLES PREPARED THEREBY, AND CONDUCTIVE PASTE USING SAME

TECHNICAL FIELD

The present invention relates to copper particles used as a filler of a conductive paste. More particularly, the present invention relates to a method of manufacturing ear-of-rice-shaped copper particles, in which the ear-of-rice-shaped copper particles are synthesized in a large amount in a short time using a room-temperature synthesis process of adding a zinc powder to a copper precursor solution, ear-of-rice-shaped copper particles manufactured thereby, and a conductive paste using the same.

BACKGROUND ART

In general, a conductive paste is manufactured by mixing a resin formulation, including a binder, a solvent, and a curing agent mixed therein, with a conductive filler. The conductive paste is widely used to form electrodes or circuits of various electric and electronic parts, or is widely used as bonding materials of devices and EMI shielding materials.

Examples of conductive filler typically used in the conductive paste include gold, silver, platinum, palladium, and copper, having high electrical conductivity. Gold, silver, platinum, and palladium have merits in that corrosion resistance is high and electricity is capable of easily flowing therethrough, but have a drawback in that they are very expensive. Copper has merits in that it is inexpensive and excellent in electrical conductivity. However, the surface of copper is easily oxidized due to the low corrosion resistance thereof, thus reducing the electrical conductivity thereof, which makes copper unsuitable for use as a conductive material.

In order to overcome this drawback of copper, the particle surface of copper may be coated with silver, although the manufacturing cost is increased.

Therefore, currently, most conductive pastes include silver, which has high electrical conductivity and which is relatively easily obtainable, as a conductive filler.

In order to reduce the high price of silver when using silver as the conductive filler, an attempt has been made to modify the shape of the silver particle so as to thus improve the electrical conductivity of the conductive paste while minimizing the amount of silver used therein.

FIG. 1 shows electrical conductivity measured depending on an addition amount when various types of silver particles are used as a conductive filler for a conductive paste. Electrical contact distribution is relatively increased when in the form of flakes rather than in the form of spherical silver particles and in the form of silver particles having many branches rather than in the form of flakes, and thus a similar electric conductivity is capable of being obtained with a small amount of addition thereof.

In particular, studies on the manufacture and application of conductive fillers in the form of dendrimer have been actively pursued as studies on conductive fillers having many branches.

It is reported that such a dendrimer-type conductive filler has electrical conductivity similar to that of a conventional flake-type filler even when using only about 50% of the addition amount in the case of a conventional flake-type filler (Nature Communication, 2015).

However, this result is obtained only when mixing of the filler and the resin formulation is performed under ideal conditions, and it is very difficult to effectively mix the dendrimer-type conductive filler with the resin formulation using a typical mixing method in the practical situation.

In particular, when the conductive filler is a dendrimer type, the surface area ratio thereof is greatly increased as the number and the length of branches are increased and the size of the manufactured particle is reduced, so that it becomes more difficult to perform uniform mixing while the resin formulation penetrates between the branches without local failures. Therefore, it is necessary to change the shape of the typical dendrimer-type filler to a somewhat integrated and simple shape in order to ensure effective mixing in an actual mixing process for paste-making.

To date, the development and study for dendrimer-type conductive filler materials has been conducted mainly using silver. However, in consideration of the characteristics of copper, which is as cheap as about 1/60 of the cost of silver and which has electrical conductivity similar to that of silver, the material of the dendrimer-type conductive filler is ultimately expected to be copper. Meanwhile, a surface treatment method using silver coating can be applied to eliminate the surface oxidation problem of the copper material.

A commonly known method of manufacturing dendrimer-type copper is to use a zinc or aluminum foil so that a copper dendrimer is generated and grows on the surface of the aluminum or zinc foil using a galvanic displacement reaction between zinc or aluminum and copper ions. Alternatively, an electrolytic application process using the above-described foils as a cathode material is used.

FIG. 2 shows an example of a conventional method of manufacturing a copper dendrimer. As shown in the drawing, an aluminum foil is immersed in an electrolytic solution containing copper ions so that the copper dendrimer grows using a galvanic displacement reaction. Electrons supplied using an oxidation reaction of aluminum are absorbed by copper ions in a solution, thus reducing copper.

However, this manufacturing method is known to be a high-cost process, in which somewhat complicated equipment is used and in which productivity is very low due to the heating process, which requires that a maximum temperature of about 120° C. be maintained for a maximum of 18 hours during a particle synthesis process, and a long synthesis time.

Further, the growth method on the foil faces an obstacle to mass production related to immersion of a large number of foils.

Further, the electrolytic process using the foils as the cathode material is widely used in order to increase a dendrimer synthesis rate, but this manufacturing method is fundamentally different from the process provided by the present invention in that it requires electricity to be applied.

Moreover, the manufacturing method using electrolysis has limitations such as the use of somewhat complicated equipment and the requirement to immerse a large number of foils for mass production.

DISCLOSURE

Technical Problem

Accordingly, the present invention has been made keeping in mind the above problems occurring in the prior art, and an object of the present invention is to provide a method of manufacturing ear-of-rice-shaped copper particles, in which the ear-of-rice-shaped copper particles are synthesized in a large amount in a short time using a room-temperature synthesis process of adding a zinc powder to a copper precursor solution, ear-of-rice-shaped copper particles manufactured thereby, and a conductive paste using the same.

Technical Solution

In order to accomplish the above object, the present invention provides a method of manufacturing ear-of-rice-shaped copper particles, ear-of-rice-shaped copper particles manufactured thereby, and a conductive paste using the same as the technical gist thereof. The method includes a first step of preparing a copper precursor solution, a second step of adjusting the pH of the copper precursor solution, a third step of adding a zinc powder to the pH-adjusted copper precursor solution, a fourth step of synthesizing the ear-of-rice-shaped copper particles by stirring the copper precursor solution, to which the zinc powder is added, for a predetermined time, and a fifth step of separating, washing, and then drying the synthesized ear-of-rice-shaped copper particles.

Further, preferably, the copper precursor solution is a copper electrolytic solution obtained by mixing 1 part by weight of copper sulfate pentahydrate ($CuSO_4.5H_2O$) or copper chloride dihydrate ($CuCl_2.2H_2O$) with 15 to 50 parts by weight of distilled water and dissolving the same therein.

Further, it is preferable to adjust the pH using sulfuric acid ($H_2SO_4$), hydrochloric acid (HCl), or acetic acid ($CH_3COOH$) in the second step. Preferably, the pH is 0.9 to 2.9.

Further, preferably, the zinc powder of the third step is added in an amount of 0.13 to 0.31 parts by weight based on 1 part by weight of the copper sulfate pentahydrate or the copper chloride dihydrate.

Further, preferably, the thickness of an oxide film of particles of the zinc powder in the third step is 0.1 to 9.9 nm, and the growth of the ear-of-rice-shaped copper particles is promoted by the oxide film of the particles of the zinc powder or by oxygen around the particles of the zinc powder in a solution.

Further, preferably, the synthesizing the ear-of-rice-shaped copper particles includes stirring at 200 to 350 rpm for 3 to 10 minutes in the fourth step.

Further, the synthesizing the ear-of-rice-shaped copper particles may include performing air blocking or injecting and discharging an inert gas into and from a synthesis system to thus inhibit surface oxidation of the synthesized ear-of-rice-shaped copper particles in the fourth step.

Further, preferably, in the ear-of-rice-shaped copper particles, the ratio of the length of a center branch to a length of a sub-branch is 1:3 to 9.

Further, preferably, in the ear-of-rice-shaped copper particles, sub-branches grow from a specific point of the center branch, the center branch and the sub-branches have different crystal orientations, and the sub-branches include additional sub-branches derived from the sub-branches.

Further, preferably, the ear-of-rice-shaped copper particles have an average particle size of 2 μm to 9 μm.

Further, preferably, the ear-of-rice-shaped copper particles are finally coated with a silver shell layer on a surface thereof.

Advantageous Effects

A method of manufacturing ear-of-rice-shaped copper particles according to the present invention is realized using a very simple method of adding a zinc powder to a copper precursor solution. Accordingly, the process is easy and mass production is capable of being achieved. Thus, it is possible to provide low-cost ear-of-rice-shaped copper particles while achieving price competitiveness.

Further, in the present invention, it is possible to minimize the consumption of energy using a room-temperature process and it further possible to greatly improve productivity using an ultra-high-speed manufacturing process in which the reaction is terminated within 10 minutes, thereby providing low-cost ear-of-rice-shaped copper particles.

Further, the ear-of-rice-shaped copper particles according to the present invention have a small particle size, and the length of a sub-branch relative to that of a center branch is relatively short compared with a conventional dendrimer type. Accordingly, it is possible to easily realize further perfect mixing with a resin formulation during a paste-making process, thereby providing a high-quality conductive paste.

The ear-of-rice-shaped copper particles according to the present invention may be used as conductive fillers for various conductive pastes, conductive fillers used for various bonding pastes for chip bonding, fillers for electromagnetic-wave-blocking pastes, and other materials for electric substances.

Figure 12:
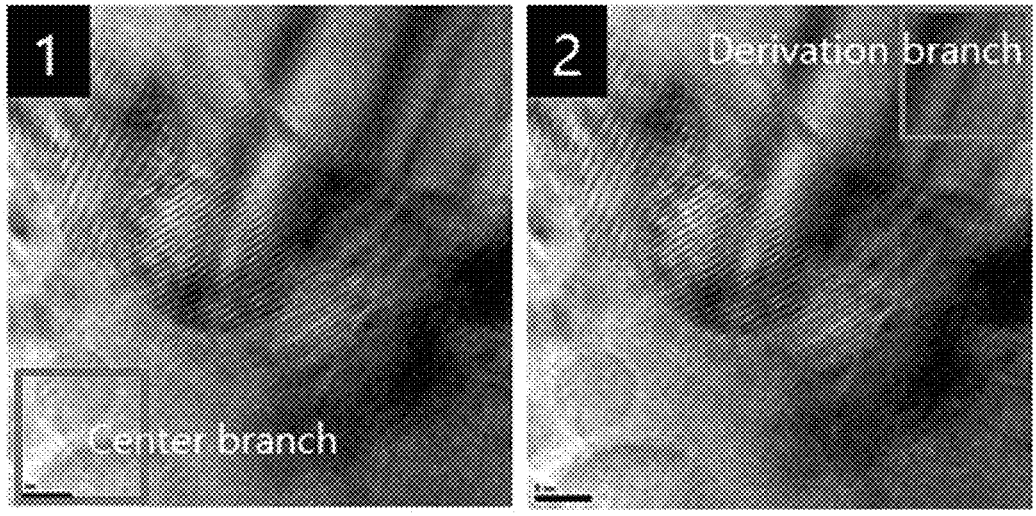
Figure 13A:
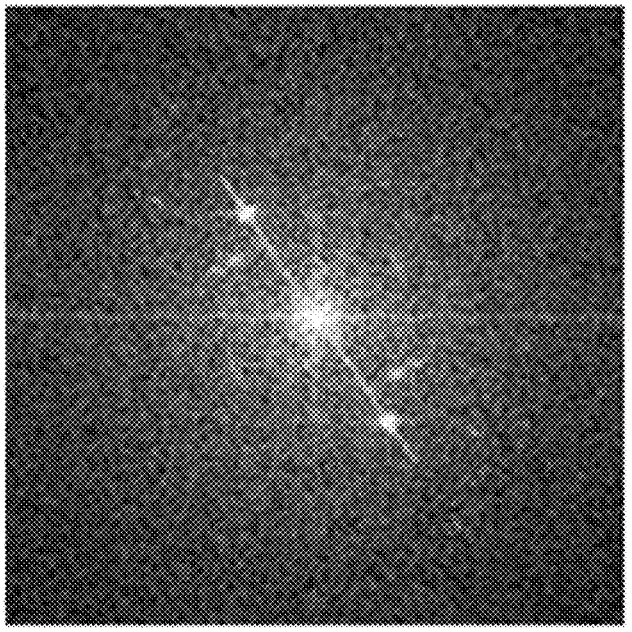
Figure 13B:
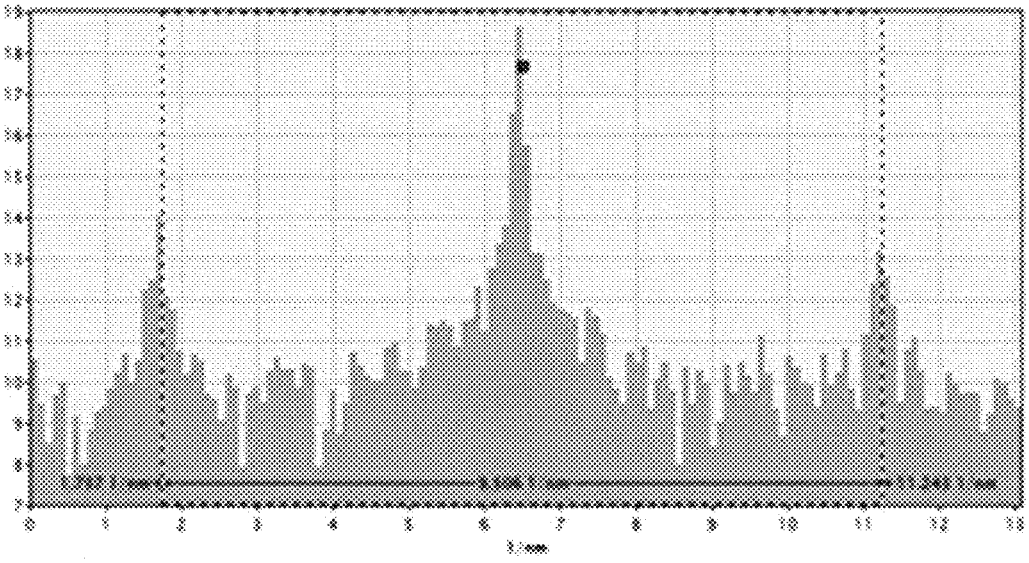
Figure 14A:
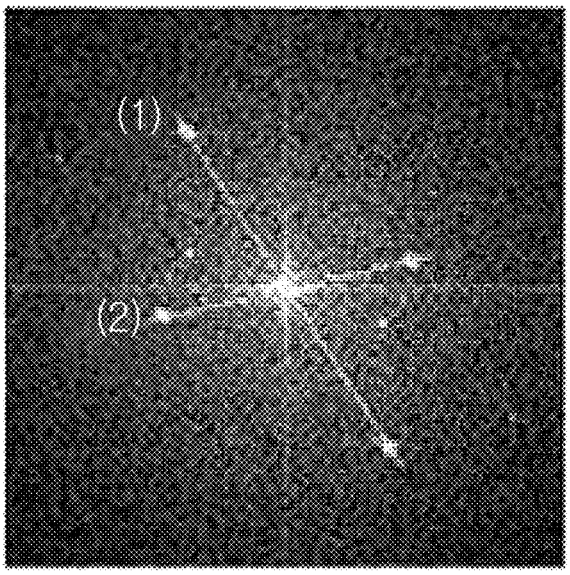
Figure 14B:
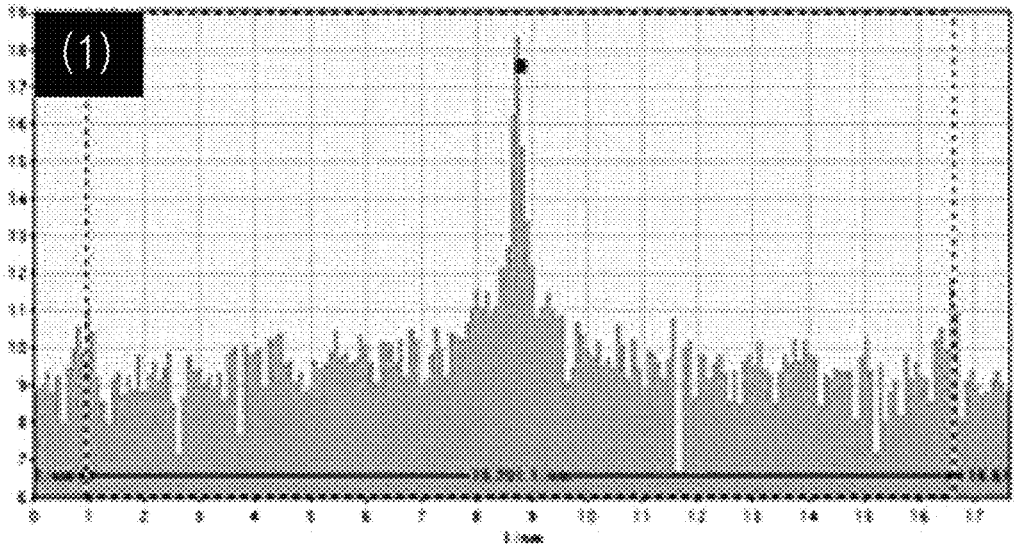
Figure 14C:
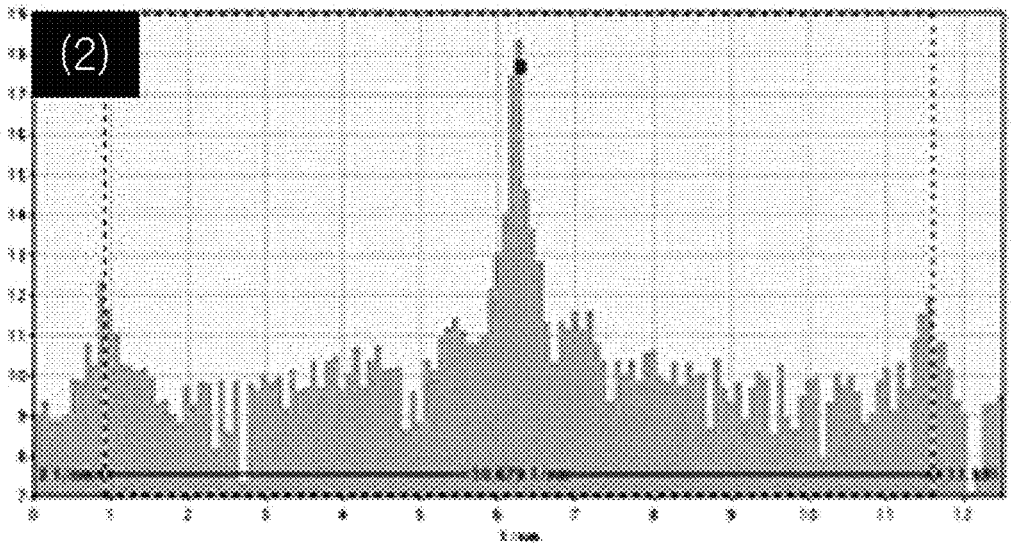
Figure 15:
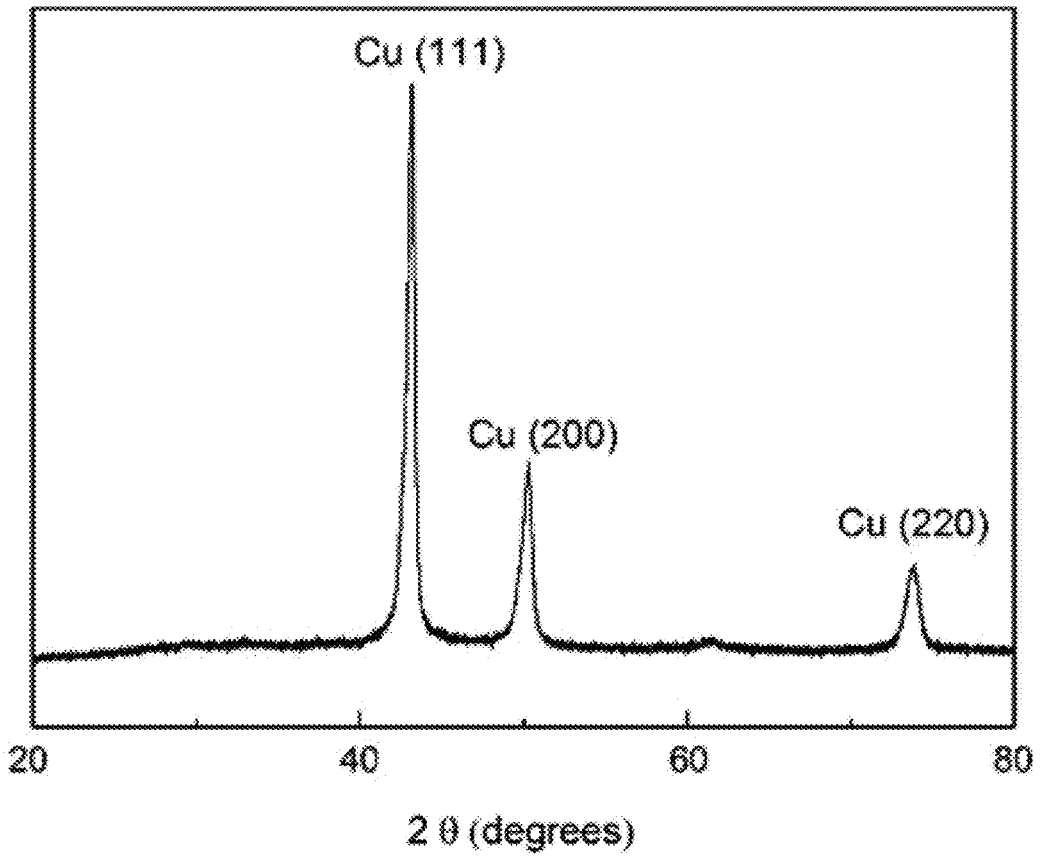
Figure 16:
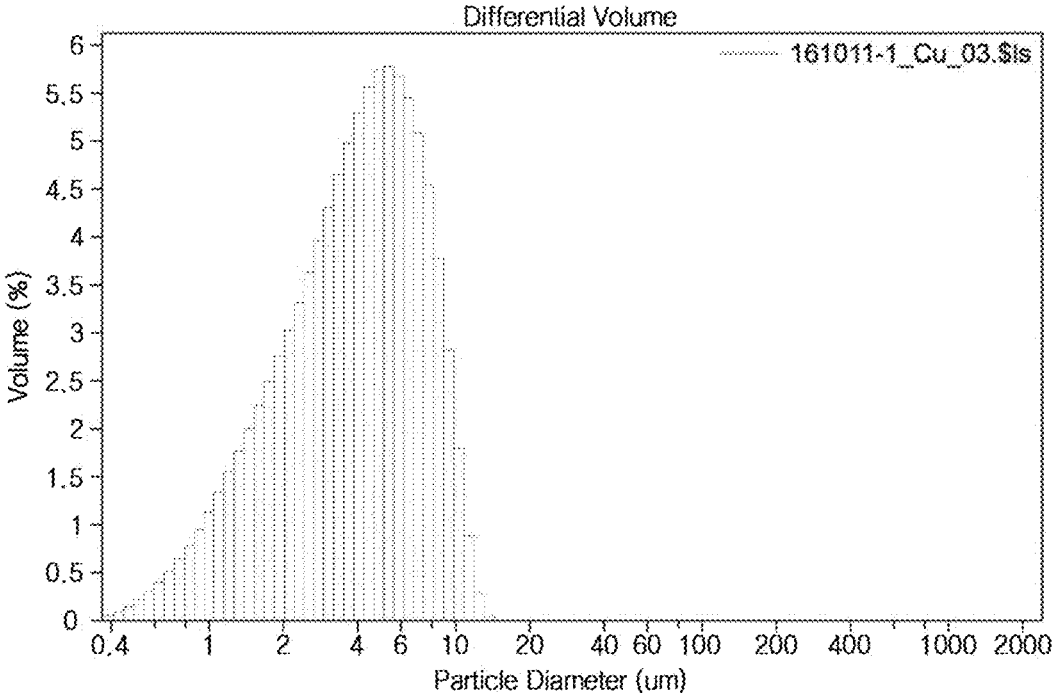

The left of FIG. 12 is a view showing a specific region set for FFT analysis of the center branch portion of the ear-of-rice-shaped copper particle according to the Example of the present invention; the right of FIG. 12 is a view showing a specific region set for FFT analysis of the sub-branch portion of the ear-of-rice-shaped copper particle according to the Example of the present invention;

FIG. 13A is a view showing the FFT analysis data of the center branch portion of the ear-of-rice-shaped copper particle according to the Example of the present invention, and FIG. 13B is a view showing the case in which the distance between spots is 9.506/nm;

FIG. 14A is a view showing the FFT analysis data of the sub-branch portion of the ear-of-rice-shaped copper particle according to the Example of the present invention, FIG. 14B is a view showing the case in which the distance between spots in any one of the sub-branches is 15.701/nm, and FIG. 14C is a view showing the case in which the distance between spots in another sub-branch is 10.679/nm;

FIG. 15 is a view showing the result of XRD (X-ray diffraction) measurement of the ear-of-rice-shaped copper particles according to the Example of the present invention; and FIG. 16 is a view showing the result of particle size measurement of the ear-of-rice-shaped copper particles according to the Example of the present invention.

BEST MODE

The present invention relates to a manufacturing method of synthesizing ear-of-rice-shaped copper particles in a large quantity using a room-temperature synthesis process in a short time, and provides ear-of-rice-shaped copper particles using a simple process of adding a zinc powder to a copper precursor solution.

Figure 3:
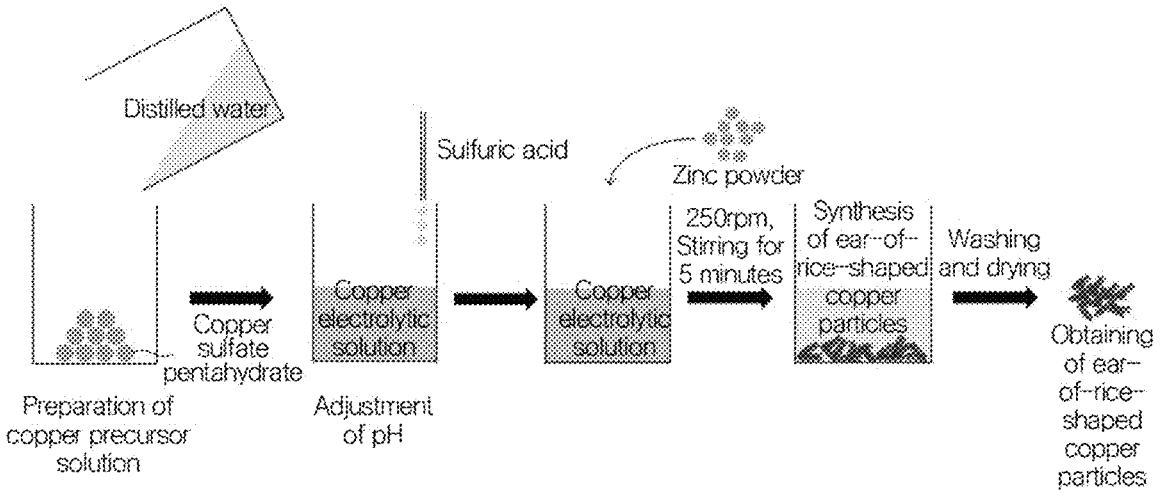
FIG. 3 is a view showing a method of manufacturing ear-of-rice-shaped copper particles according to the present invention.

Hereinafter, the present invention will be described in detail with reference to the accompanying drawings. FIG. 3 is a schematic view showing a method of manufacturing ear-of-rice-shaped copper particles according to the present invention.

As shown in the drawing, the ear-of-rice-shaped copper particles according to the present invention are obtained by a method including a first step of preparing a copper precursor solution, a second step of adjusting the pH of the copper precursor solution, a third step of adding a zinc powder to the pH-adjusted copper precursor solution, a fourth step of synthesizing the ear-of-rice-shaped copper particles by stirring the copper precursor solution, to which the zinc powder is added, for a predetermined time, and a fifth step of separating the synthesized ear-of-rice-shaped copper particles from the copper precursor solution, followed by washing and then drying.

Figure 4A:
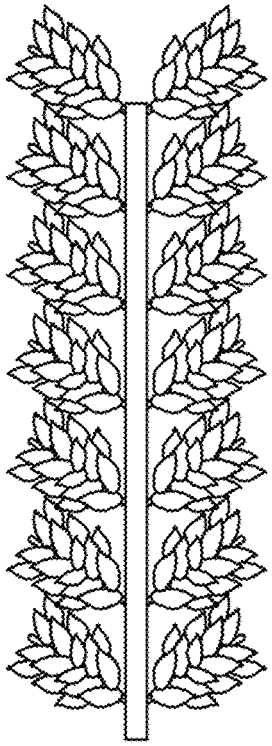
FIG. 4A is a schematic of the ear-of-rice-shaped copper particles according to the present invention.

In general, the shape of the copper particle according to the present invention is such that, as shown in FIG. 4A, a plurality of short sub-branches is formed in a bundle type with respect to a center branch and an additional plurality of short sub-branches is formed in a bundle type with respect to the sub-branches. The overall shape thereof is similar to an ear of rice.

Figure 4B:
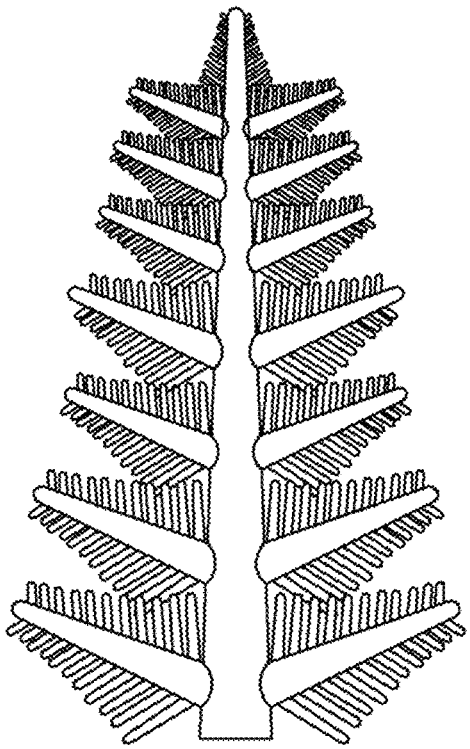
FIGS. 4B and 4C are schematics of conventional dendrimer-type particles.
Figure 4C:
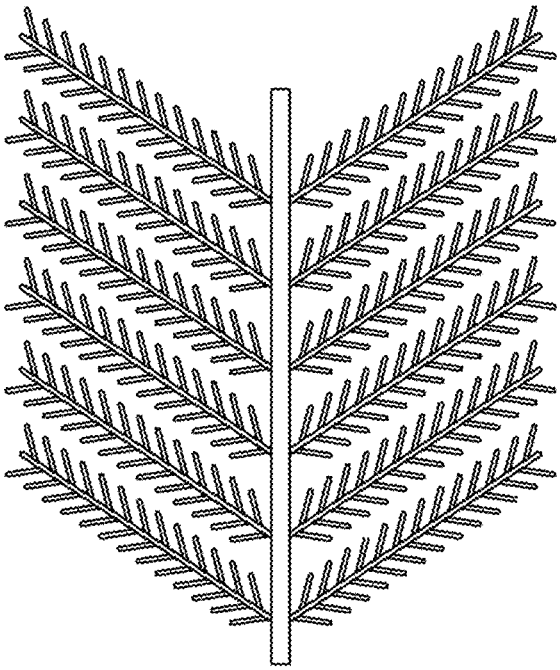

A conventional dendrimer, such as a silver or copper dendrimer, has a plurality of sub-branches with respect to a center branch as shown in FIG. 4B or 4C. A plurality of further sub-branches is formed from the sub-branches. In this regard, the sub-branches are formed in an aligned arrangement rather than a bundled arrangement, and the aligned primary sub-branches are relatively thick and tapered as they grow, and the length thereof is considerably longer than that of the branches in the ear-of-rice-shaped type. The sub-branches are gradually reduced in length from the bottom to the top of the center branch (FIG. 4B). Alternatively, the sub-branches are formed in an aligned type rather than a bundle type, the aligned primary sub-branches are thin and the difference in thickness depending on the length is insignificant, the length thereof is prominently long, and there is no length variation of the sub-branches at the bottom and top of the center branch (FIG. 4C). Therefore, the conventional dendrimer differs in shape from the ear-of-rice-shaped copper particles manufactured using the manufacturing method of the present invention.

Conventional dendrimer-type particles are very difficult to uniformly mix with the resin formulation during the paste-making step. However, the ear-of-rice-shaped copper particles according to the present invention have a bundle-type branch structure and a short branch length, thus having a merit in that the particles are readily and uniformly mixed with the resin formulation. Further, since a contact area between the particles is basically increased due to the sub-branches, the merit of obtaining high electrical conductivity through addition of a small amount of particles may still be maintained.

First, the copper precursor solution is prepared in order to manufacture the ear-of-rice-shaped copper particles according to the present invention.

The copper precursor solution may be synthesized using copper by a certain chemical reaction. In the present invention, a copper electrolytic solution is used, and the ear-of-rice-shaped copper particles are generated and then grow on the surface of the target, that is, the zinc powder particles, on which the galvanic displacement reaction is induced, due to the galvanic displacement reaction between the surface atoms of the zinc powder to be added and the copper ions.

As such a copper electrolytic solution, a substance in which copper sulfate pentahydrate ($CuSO_4.5H_2O$) is mixed with distilled water or a substance in which copper chloride dihydrate ($CuCl_2.2H_2O$) is mixed with distilled water is used. 15 to 50 parts by weight of distilled water is used in the mixture based on 1 part by weight of the copper sulfate pentahydrate or the copper chloride dihydrate.

The concentration of the copper electrolytic solution is determined in consideration of efficiency of a production process. That is, when the amount of the solvent is very small, the concentration of the copper particles that are generated is increased, so that the shape of the ear of rice may be broken, severe agglomeration of the ear-of-rice-shaped copper particles may occur, or the dispersion of the ear-of-rice-shaped copper particles may be deteriorated. Further, when the ear-of-rice-shaped copper particles are synthesized, they are precipitated on the bottom. Therefore, when the amount of the solvent is very large, a simple process in which the solvent in the upper layer is drained may be added. However, an excessively large amount of solvent is not preferable in order to avoid wasting the solvent.

The pH of the copper precursor solution that is prepared is adjusted to add the zinc powder, and the resultant material is stirred for a predetermined period of time, thus synthesizing the ear-of-rice-shaped copper particles.

The zinc powder is added in an amount of 0.13 to 0.31 parts by weight based on 1 part by weight of the copper sulfate pentahydrate or copper chloride dihydrate. In order to adjust the pH of the copper precursor solution, sulfuric acid ($H_2SO_4$), hydrochloric acid (HCl), acetic acid ($CH_3COOH$), or an appropriate mixture thereof is used.

In the present invention, since copper and zinc participating in the reaction are reacted at a weight ratio of approximately 1:1, it is preferable to determine the amount of zinc powder to be added in consideration thereof. However, in order to increase the generation rate of the copper particles while using the zinc powder particles, which are hardly oxidized, the amount of zinc powder may be slightly further increased. Alternatively, in order to remove the zinc powder particles from the solution in a short time while using the zinc powder particles, which are highly oxidized, the amount of zinc may be further reduced. However, both of the above cases greatly affect the shape of the finally generated copper particles, which will be described later in connection with FIG. 6 again.

Sulfuric acid, hydrochloric acid, or acetic acid is used in order to adjust the pH of the copper precursor solution. The pH is preferably about 0.9 to 2.9, and more preferably about 2. That is, setting of a proper pH value greatly affects smooth progress of the above-mentioned galvanic displacement reaction.

Meanwhile, the zinc powder in the present invention preferably includes surface-oxidized zinc, that is, zinc powder particles having an oxide film, rather than pure zinc powder particles, and the thickness of the oxide film is preferably 0.1 nm to 9.9 nm.

This means that zinc particles having an oxide film naturally formed during exposure to the atmosphere at room temperature or zinc powder particles having a slightly thicker oxide film formed by increasing an exposure time or a temperature are used. The ear-of-rice-shaped copper particles grow on the surface of the zinc particles, and the growth is promoted by the oxide film formed on the surface of the zinc particles or oxygen around the zinc particles in the solution.

In general, silver or copper dendrimer-type particles are generated on the surface of metal, such as aluminum or zinc, on the surface of which an oxide film readily forms. Accordingly, the surface oxide film is considered to be a main cause of dendrimer-type particle generation. In the present invention, the growth of the center branches of the ear-of-rice-shaped copper particles starts from the oxide film on the surface of the zinc particles, and then the growth of the sub-branches of the ear-of-rice-shaped copper particles rapidly occurs together with the growth of the center branches. With respect to this rapid reaction rate, it is considered that the reaction is promoted by the oxide film of the zinc particles or by the oxygen that is generated from oxygen ions dissociated after the zinc powder is added or during the growth process of the ear-of-rice-shaped particles and which is positioned around the zinc particles in the solution. The oxide film formed on the zinc is known to be in a porous form, which accelerates dissociation into oxygen ions due to high reactivity.

That is, in oxidation reaction of zinc and the reduction reaction of copper, the oxide film or oxygen plays a role of promoting the reaction, and this rapid reaction rate is equally applied to the growth of all the copper crystal faces. Accordingly, copper particles having a shape that is similar to a circle are not formed, but the center branch rapidly grows from a precedence growth face, that is, face (111), in a direction perpendicular to the oxide film. Subsequently, the sub-branches of a specific crystal face grow in a specific direction toward a position of relatively high oxygen concentration so as to finally have an ear-of-rice shape. The growth behavior of the center branch at the rapid reaction rate causes periodic generation of defects. Since these defects exhibit high surface energy characteristics, the defects may become the growth starting point of new sub-branches.

Therefore, among the above-described sub-branches of the ear-of-rice-shaped copper particles according to the present invention, further sub-branches derived from the above-described sub-branches are included. That is, if the pH of the electrolytic solution and oxygen appropriately affect, the oxidation and reduction reactions are further promoted, resulting in rapid growth of the center branches. This leads to generation of more defects in the center branch, which leads to the growth of many sub-branches from the center branch or the growth of further sub-branches derived from the sub-branches as well as the growth of the center branch.

Thus, it could be confirmed that the ear-of-rice-shaped copper particles finally synthesized are not obtained in the form of a single crystal but are manufactured in a polycrystalline form in which the center branch and the sub-branch have different crystal orientations.

The rapid growth of the branches using the catalytic properties of the oxygen mentioned above may be realized using a method for increasing the dissolved oxygen amount in the solution, but an excessive dissolved oxygen amount may cause oxidation of the synthesized ear-of-rice-shaped copper particles, so attention is required.

Meanwhile, the thickness of the oxide film on the zinc particle is preferably 0.1 to 9.9 nm. When the thickness is smaller than the above range, the growth-promoting behavior by oxygen is not realized. When the thickness is greater than the above range, since the zinc atoms cannot participate smoothly in the galvanic displacement reaction that is ultimately performed, the synthesis reaction cannot proceed.

In the ear-of-rice-shaped copper particles of the present invention that is manufactured, the ratio of the length of the center branch to the length of the sub-branch is about 1:3 to 9. That is, when the length of the center branch is shorter or longer than the above range, the shape thereof is difficult to consider to correspond to an ear of rice. When the length of the sub-branch is longer than the above range, it is very difficult to uniformly mix with the resin formulation when used as the conductive filler in the paste.

Further, since the average particle size of the ear-of-rice-shaped copper particles is as small as 2 μm to 9 μm, the density of particles may be further increased compared with conventional dendrimer-type particles when used as a conductive filler of a conductive paste, thus providing a high-quality conductive paste.

In order to uniformly cause such a reaction in the copper precursor solution, stirring is performed for a predetermined period of time, preferably at 200 rpm to 350 rpm for 3 to 10 minutes. This is to minimize the remaining rate of unreacted zinc powder and to reduce the reaction time.

Further, the ear-of-rice-shaped copper particles may be synthesized by performing air blocking and injecting and discharging an inert gas, such as nitrogen or argon, into and from a synthesis system to thus inhibit surface oxidation of the synthesized ear-of-rice-shaped copper particles.

The manufacturing method according to the present invention has the greatest advantage in that the reaction is almost completed within 10 minutes regardless of the amounts of copper and zinc involved in the reaction, thus synthesizing the ear-of-rice-shaped copper particles at a high rate. Moreover, since the synthesis reaction proceeds at room temperature, there is no problem of equipment and heat transfer in increasing the scale of the synthesis reaction, and therefore, the manufacturing method has a clear merit in terms of production cost reduction through mass synthesis.

The ear-of-rice-shaped copper particles that are synthesized may be separated from the electrolytic solution remaining immediately after the synthesis step of the ear-of-rice-shaped copper particles, washed with distilled water, methanol, or ethanol, and rapidly dried by heating in an oven in a vacuum state or on a hot plate in a vacuum chamber, so that the remaining washing liquid is removed to obtain the ear-of-rice-shaped copper particles.

Meanwhile, a silver shell layer may be applied on the surface of the ear-of-rice-shaped copper particles that are obtained, thus providing a low-cost conductive filler in which the oxidation of the ear-of-rice-shaped copper particles is prevented and the contact resistance characteristics of the entire particles are improved. The application of the silver shell layer may be realized using various conventional methods such as electroless silver plating.

As described above, a method of manufacturing ear-of-rice-shaped copper particles according to the present invention is realized using a very simple method of adding a zinc powder to a copper precursor solution. Accordingly, the process is easy and copper particles are formed on the zinc powder particles in the process, whereby mass production is capable of being achieved. Thus, it is possible to provide low-cost ear-of-rice-shaped copper particles having the best price competitiveness.

Further, with the present invention, it is possible to minimize the consumption of energy using a room-temperature process and it is also possible to greatly improve productivity using an ultra-high-speed manufacturing process in which the reaction is terminated within 10 minutes, thereby providing low-cost ear-of-rice-shaped copper particles.

Further, ear-of-rice-shaped copper particles according to the present invention have a small particle size, and the length of a sub-branch relative to a center branch is relatively short compared with a conventional dendrimer type. Accordingly, it is possible to easily improve the mixing with a resin formulation during a paste-making process, thereby providing a high-quality conductive paste.

The ear-of-rice-shaped copper particles according to the present invention may be used as conductive fillers for various conductive pastes, conductive fillers used for various bonding pastes for chip bonding, fillers for EMI shielding pastes, and other materials for electric substances.

Mode for Invention

Hereinafter, an Example of the present invention will be described.

First, after 2 g of copper sulfate pentahydrate was dissolved in 50 ml of distilled water, the pH was adjusted to 2 by adding sulfuric acid. After this solution was charged into a sealed vessel, the reaction system was continuously kept isolated from the atmosphere while nitrogen was blown into one side thereof and nitrogen was discharged from the other side thereof. After 0.6 g of a zinc powder was added thereto, copper particles were synthesized by stirring at 250 rpm for 5 minutes. Subsequently, the supernatant was drained, first washing was performed using distilled water, the supernatant was drained, second washing was performed using methanol, and the supernatant was drained, followed by rapid drying on a hot plate at 60° C. in a low-vacuum chamber.

The copper sulfate pentahydrate ($CuSO_4.5H_2O$) has a molecular weight of 249.68, the atomic weight of copper is 63.546, and the atomic weight of zinc is 65.41. When 2 g of the copper sulfate pentahydrate is completely reduced to copper, 0.509 g ((63.546/249.68)×2 g) of copper may be generated.

Since copper and zinc react at a molar ratio of 1:1 in the solution, the amount of zinc (x) necessary for complete reduction of Cu is calculated to be 0.5239 g by 0.509/63.546=x/65.41. In the present Example, 0.6 g of the zinc powder was added to provide sufficient zinc.

Figure 5:
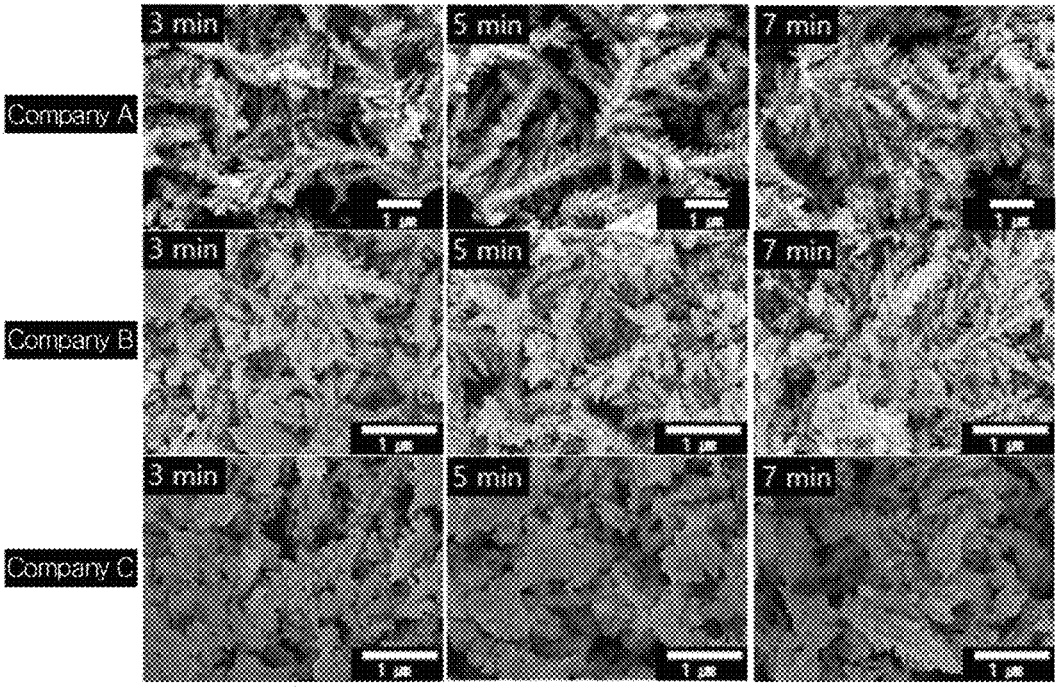
FIG. 5 is a view showing a SEM photograph of ear-of-rice-shaped copper particles manufactured according to an Example of the present invention (zinc powders provided by three manufacturers of commercially available zinc powder are used)

The electron micrographs of the ear-of-rice-shaped copper particles, which were synthesized for each supplier of zinc powder so that the above-described Example was satisfied, were obtained, and are shown in FIG. 5.

FIG. 5 shows a SEM (scanning electron microscope) photograph of ear-of-rice-shaped copper particles synthesized using zinc powders provided by three manufacturers of commercially available zinc powder. The desired ear-of-rice-shaped copper particles were successfully synthesized in the case of powder from company A, but the results were not satisfactory in the case of powders from company B and company C. Some causes may be suggested for the difference in these results, and the degree of oxidation of the zinc powder that was used was determined to be the biggest cause.

Figure 6:
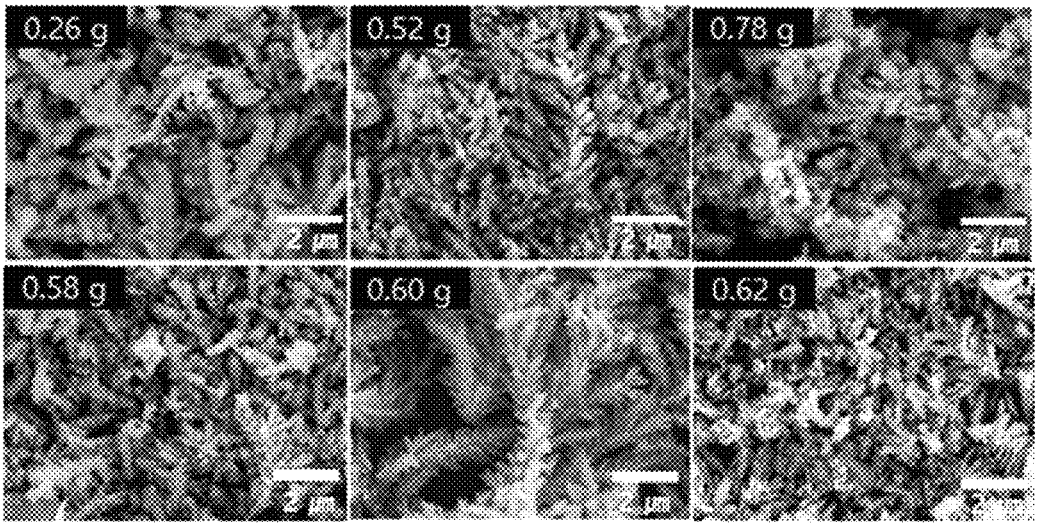
FIG. 6 is a view showing a SEM photograph of the ear-of-rice-shaped copper particles manufactured according to the Example of the present invention (the ear-of-rice-shaped copper particles are manufactured with different amounts of zinc powder that is added)

FIG. 6 shows a SEM photograph of the ear-of-rice-shaped copper particles manufactured while changing the amount of the zinc powder provided by company A. When 0.6 g of the zinc powder was added, it could be confirmed that the ear-of-rice-shaped copper particles having the most desired shape were synthesized.

Figure 7:
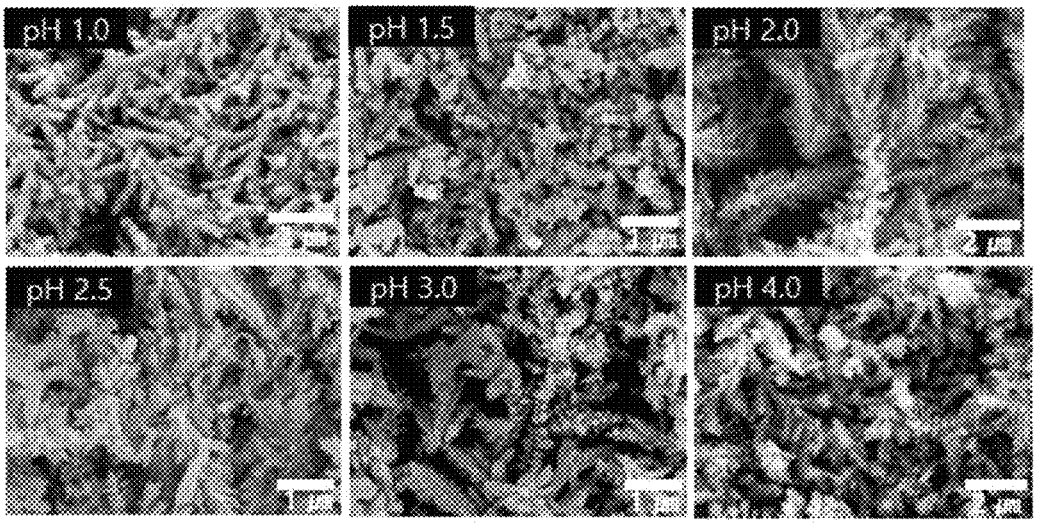
FIG. 7 is a view showing a SEM photograph of the ear-of-rice-shaped copper particles manufactured according to the Example of the present invention (the ear-of-rice-shaped copper particles are manufactured at varying pH)

FIG. 7 shows a SEM photograph of the ear-of-rice-shaped copper particles manufactured for each pH by adding 0.6 g of the zinc powder provided by company A. The pH was adjusted using sulfuric acid. As shown in FIG. 7, it could be confirmed that the ear-of-rice-shaped copper particles having the most desired shape were synthesized at a pH of 2.

Figure 8:
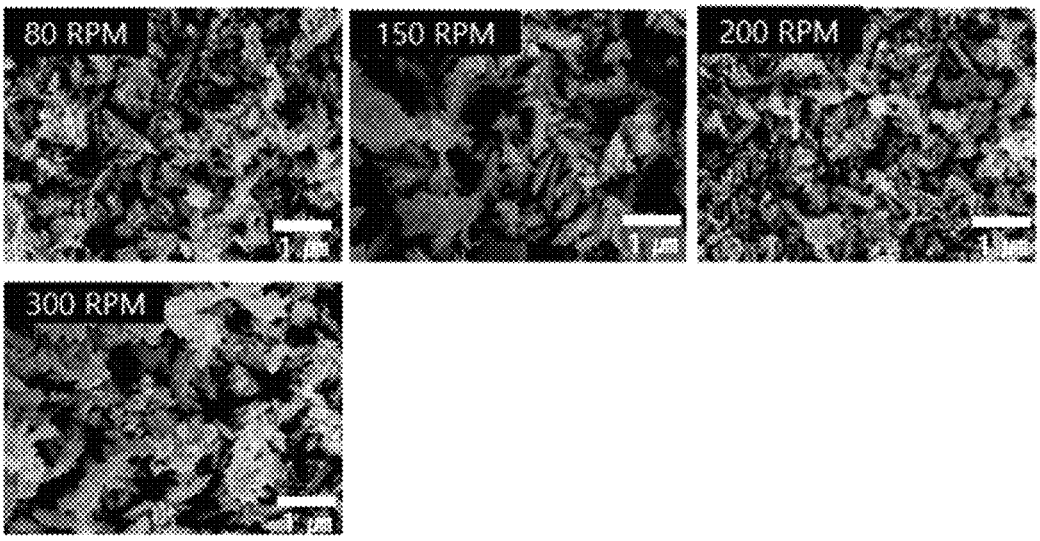
FIG. 8 is a view showing a SEM photograph of the ear-of-rice-shaped copper particles manufactured according to the Example of the present invention (the ear-of-rice-shaped copper particles are manufactured at different stirring speeds)

FIG. 8 shows a SEM photograph of the ear-of-rice-shaped copper particles manufactured by adding 0.6 g of the zinc powder provided by company A to thus adjust the pH of the copper electrolytic solution to 2 and then stirring at different stirring speeds. From the SEM image, it could be confirmed that the most suitable stirring condition was to use stirring speeds of 200 rpm and 350 rpm.

Figure 9:
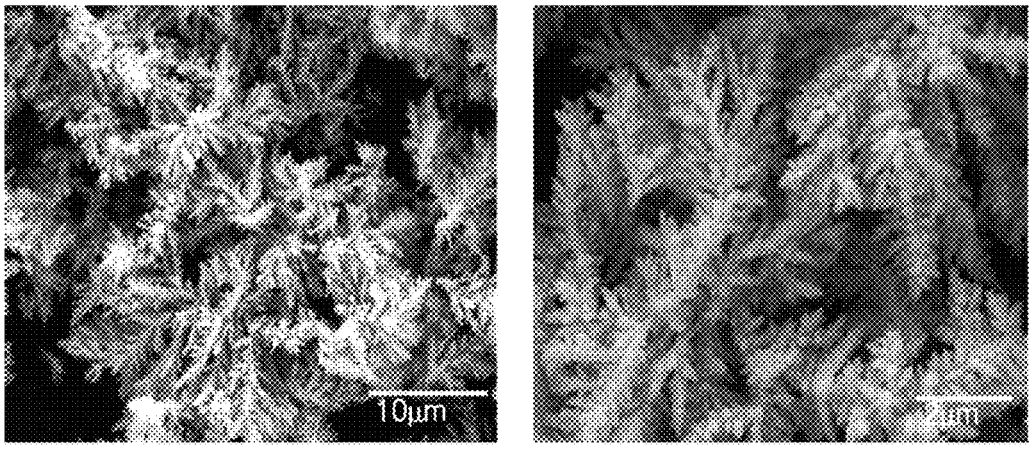
FIG. 9 is a view showing a SEM photograph of the ear-of-rice-shaped copper particles manufactured according to the Example of the present invention (the ear-of-rice-shaped copper particles are manufactured in a large quantity)

FIG. 9 shows the results of the ear-of-rice-shaped copper particles manufactured in a large quantity. After 20 g of copper sulfate pentahydrate was dissolved in 500 ml of distilled water, sulfuric acid was added thereto to adjust the pH to 2. 6 g of the zinc powder was added thereto, followed by stirring at 250 rpm for 5 minutes. In addition, after the synthesis, the supernatant was drained, first washing was performed using distilled water, the supernatant was drained, second washing was performed using methanol, and the supernatant was drained, followed by drying on a hot plate at 60° C. in a low-vacuum chamber, thereby manufacturing the ear-of-rice-shaped copper particles, and the SEM photograph of the ear-of-rice-shaped copper particles is shown in FIG. 10.

Although the reaction was performed for the same time as in the reaction at 50 ml, it could be confirmed that the ear-of-rice-shaped copper particles were manufactured without any significant difference in particle shape. This shows that reproducibility is capable of being ensured as long as uniform stirring is maintained even when synthesizing a large amount thereof, and thus it is possible to produce the ear-of-rice-shaped copper particles in greatly large quantities at a greatly high level due to the ease and rapidity of the process.

Figure 10:
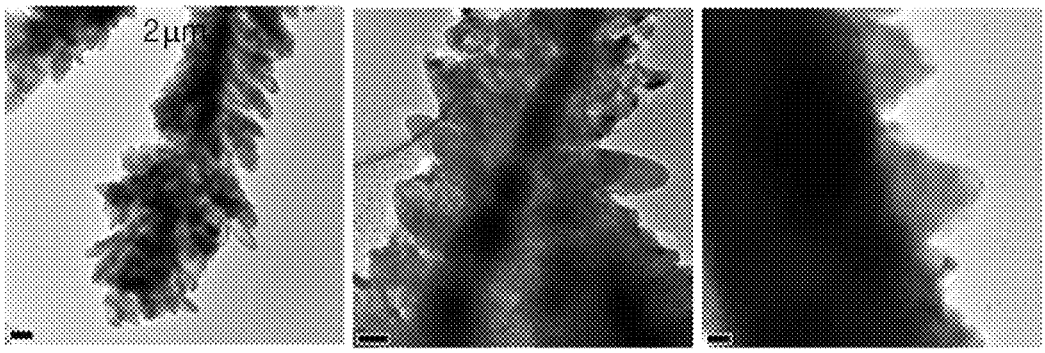
FIG. 10 is a view showing a TEM photograph of the ear-of-rice-shaped copper particles manufactured according to the Example of the present invention.

FIG. 10 shows a TEM (transmission electron microscope) photograph of the dried ear-of-rice-shaped copper particles, in which protrusions were observed on the center branch and the sub-branch. Further, it was clearly observed that the sub-branches were generated in a bundle type rather than in an aligned type in the ear-of-rice-shaped copper particles of the present invention, as shown in the schematic of FIG. 4A.

Figure 11:
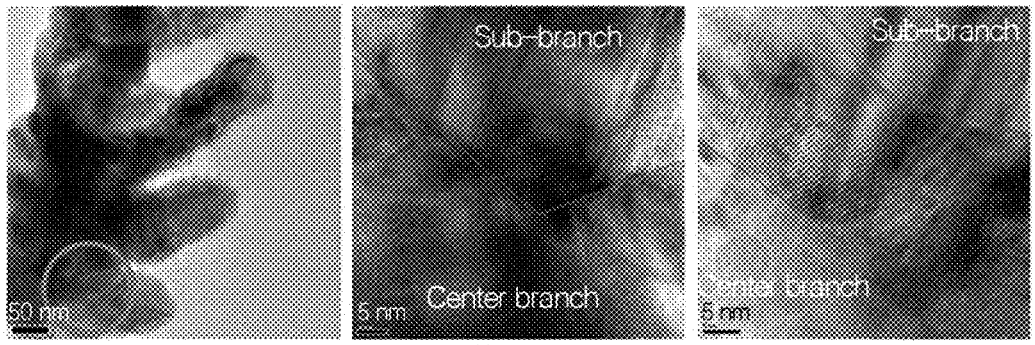
FIG. 11 is a view showing a TEM photograph of the ear-of-rice-shaped copper particles and a boundary between center and sub-branches according to the Example of the present invention.

FIG. 11 shows a TEM photograph of the ear-of-rice-shaped copper particles and a boundary between center and sub-branches according to the Example. It was confirmed that the crystal orientations of the center and sub-branches were remarkably different from each other. This shows that the ear-of-rice-shaped copper particles have a polycrystalline structure.

Figure 1:
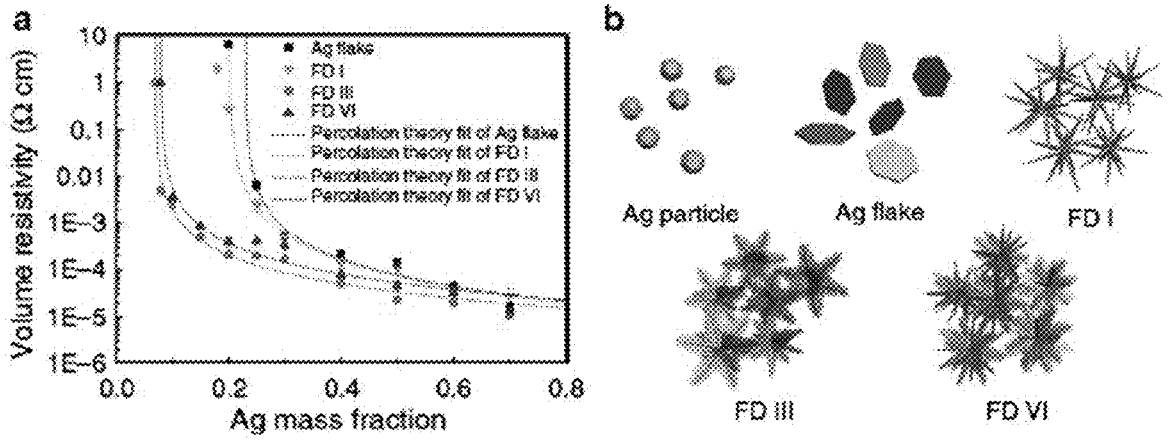
FIG. 1 is a view showing the electrical conductivity measured depending on an addition amount when various types of silver particles are used as a filler for a paste.
Figure 2:
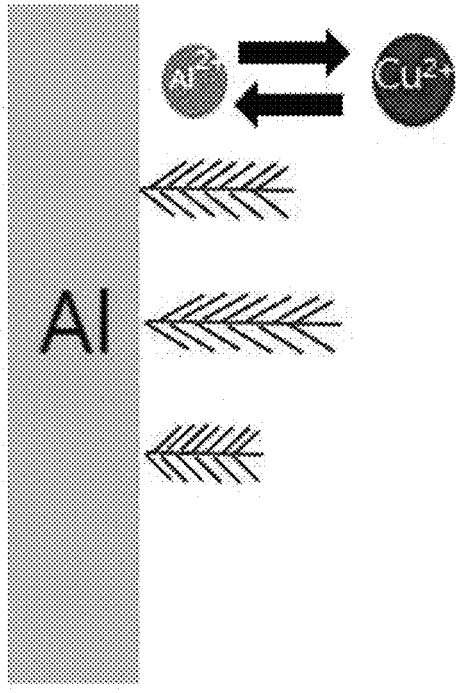
FIG. 2 is a schematic showing a conventional method of manufacturing a copper dendrimer using a foil.

FIG. 12 shows a specific region set for FFT (Fast Furier Transform) analysis in the TEM photograph. FIG. 12-1 shows a specific region set for the FFT analysis in the center branch, and FIG. 12-2 shows a specific region set for the FFT analysis in the sub-branch.

FIG. 13A shows the FFT analysis data of the regions in the center branch, and FIG. 13B shows the case in which the distance between spots is 9.506/nm. The distance between faces calculated therefrom is exhibited to be 2.103 Å (2/9.506=0.2103 nm), indicating that the (111) face of Cu grew.

FIG. 14A shows the FFT analysis data of the sub-branches, FIG. 14B shows the case in which the distance between spots in any one of the sub-branches is 15.701/nm, and FIG. 14C shows the case in which the distance between spots in another sub-branch is 10.679/nm. The distances between faces calculated therefrom are exhibited to be 1.274 Å and 1.872 Å, indicating that the sub-branches were generated through the growth of the faces (220) and (200) of Cu.

As a result, from the FFT analysis, it could be seen once again that the center branch results from the growth of the face (111) and the sub-branch results from the growth of the faces (200) and (220), whereby the ear-of-rice-shaped copper particles have a polycrystalline tissue.

FIG. 15 is a graph showing the result of XRD measurement of the ear-of-rice-shaped copper particles synthesized according to the Example. In the synthesized particles, the results of detection of only the faces (111), (200), and (220) were obtained. These results are in good agreement with the results of the above-described TEM analysis. Therefore, even from the XRD analysis, it could be confirmed that the center branches were mainly generated through the growth of the face (111) and the sub-branches were generated through the growth of the faces (200) and (220).

FIG. 16 shows an analysis of the particle size for the above-described Example, in which a large number of particles are distributed in a size range of 2 to 10 μm and the average size thereof is measured to be 4 μm.

The invention claimed is:

1. A method of manufacturing ear-of-rice-shaped copper particles, the method comprising:

a first step of preparing a copper precursor solution;

a second step of acidifying the copper precursor solution to be in a range of from 0.9 to 2.9 to give a pH-adjusted copper precursor solution;

a third step of adding a zinc powder to the pH-adjusted copper precursor solution;

a fourth step of synthesizing the ear-of-rice-shaped copper particles by stirring the copper precursor solution, to which the zinc powder is added, for a predetermined time; and a fifth step of separating, washing, and then drying the synthesized ear-of-rice-shaped copper particles.

2. The method of claim 1, wherein the copper precursor solution is a copper electrolytic solution obtained by mixing 1 part by weight of copper sulfate pentahydrate ($CuSO_4.5H_2O$) or copper chloride dihydrate ($CuCl_2.2H_2O$) with 15 to 50 parts by weight of distilled water and performing dissolving.

3. The method of claim 1, wherein the copper precursor solution is a copper electrolytic solution obtained with copper sulfate pentahydrate, and wherein the zinc powder of the third step is added in an amount of 0.13 to 0.31 parts by weight based on 1 part by weight of copper sulfate pentahydrate.

4. The method of claim 1, wherein the pH is acidified using any one of sulfuric acid ($H_2SO_4$), hydrochloric acid (HCl), and acetic acid ($CH_3COOH$) or by mixing two or more thereof in the second step.

5. The method of claim 1, wherein a thickness of an oxide film of particles of the zinc powder in the third step is 0.1 to 9.9 nm.

6. The method of claim 5, wherein growth of the ear-of-rice-shaped copper particles is promoted by the oxide film of the particles of the zinc powder or by oxygen in a solution.

7. The method of claim 1, wherein the synthesizing the ear-of-rice-shaped copper particles includes stirring at 200 to 350 rpm for 3 to 10 minutes in the fourth step.

8. The method of claim 1, wherein the synthesizing the ear-of-rice-shaped copper particles is performed in an inert gas atmosphere to inhibit surface oxidation of the synthesized ear-of-rice-shaped copper particles in the fourth step.

9. The method of claim 1, wherein the ear-of-rice-shaped copper particles are coated with a silver shell layer on a surface thereof.

* * * * *